United States Patent [19]

Penney

[11] 4,259,707

[45] Mar. 31, 1981

[54] SYSTEM FOR CHARGING PARTICLES ENTRAINED IN A GAS STREAM

[76] Inventor: Gaylord W. Penney, 216 Paris Rd., Pittsburgh, Pa. 15235

[21] Appl. No.: 2,908

[22] Filed: Jan. 12, 1979

[51] Int. Cl.[3] ..... H01T 19/00; B03C 3/41

[52] U.S. Cl. ..... 361/212; 55/137; 55/138; 55/149; 55/150; 361/226

[58] Field of Search ..... 55/136–138, 55/149–150; 361/212–213, 226

[56] References Cited

U.S. PATENT DOCUMENTS

| | | | |
|---|---|---|---|
| 2,579,440 | 12/1951 | Palmer | 55/149 X |
| 2,698,669 | 1/1955 | Wintermute | 55/150 X |
| 2,800,193 | 7/1957 | Beaver | 55/149 X |
| 3,008,541 | 11/1961 | Wachter | 55/149 X |
| 3,026,964 | 3/1962 | Penney | 55/137 |
| 3,375,638 | 4/1968 | Dungler | 55/149 X |
| 3,966,435 | 6/1976 | Penney | 55/150 X |

FOREIGN PATENT DOCUMENTS

| | | | |
|---|---|---|---|
| 2734133 | 4/1978 | Fed. Rep. of Germany | 55/138 |
| 846522 | 8/1960 | United Kingdom | 55/138 |

*Primary Examiner*—Kathleen J. Prunner
*Attorney, Agent, or Firm*—Thomas H. Murray

[57] ABSTRACT

A system for charging dust and the like particles entrained in a gas stream and which are to be electrostatically precipitated. An emitter electrode is disposed in the gas stream for producing ions of one polarity which charge particles in the gas stream. These ions of one polarity and the charged particles are attracted to a surface on which at least a portion of the charged particles collect. The invention resides in the use of a second emitter electrode for producing ions of the opposite polarity which neutralize the ions of the first polarity which have been attracted to the surface and prevent the build-up of a voltage gradient across the particle layer on the surface.

16 Claims, 10 Drawing Figures

SYSTEM FOR CHARGING PARTICLES ENTRAINED IN A GAS STREAM

BACKGROUND OF THE INVENTION

As is known, there are essentially two types of electrostatic precipitators. In one, called a single-stage precipitator, particles entrained in a gas stream are charged in passing through a corona discharge and are then collected on grounded electrodes disposed adjacent the emitter electrodes which produce the corona discharge. In the other type of precipitator, called a two-stage precipitator, the particles are initially charged by a corona discharge and then travel downstream to collecting plates. In either case, a wire at high potential is mounted midway between relatively large electrodes. The high electric field at the wire produces a glow which is the source of ions. If the wire is negative, negative ions will be repelled from the wire and the ions will travel through the gas toward the passive or grounded electrode. Dust is charged by passing through this corona discharge, and some of this dust will be deposited on the passive electrode, even in the case of a two-stage precipitator. The corona current must then be conducted through this layer of collected dust; and even though the corona current is only a fraction of a microampere per square centimeter, if the dust has a high resistivity, the voltage drop through the dust may exceed its breakdown voltage gradient. This gives high local electric fields at the dust surface which produce the well-known back-corona effect wherein an electrical breakdown of the dust layer occurs at one or more points and, for example with negative corona, results in positive ions which partly neutralize the negative charge which the dust particles received in the ionizing corona. This back-corona effect greatly reduces the particle charge and may reduce the voltage which can be applied to the ion-emitting electrode or wire.

SUMMARY OF THE INVENTION

In accordance with the present invention, back-corona and reduction in precipitator efficiency are minimized by subjecting the passive electrode on which the dust collects to both positive and negative corona. In this regard, the corona at a given point on the passive electrode is alternately positive and negative. With the charge from the positive corona equal to the charge from the negative corona, and with the reversals frequent enough so that the breakdown voltage of the dust layer is not exceeded, no current is conducted through the layer of collected dust and the dust merely functions as a capacitor. Thus, the resistivity of the dust may be indefinitely high without causing back-corona. While the passive electrode is subjected to alternating corona, the aerosol paths through which the dust-laden air pass are such that a given aerosol stream passes through corona of one polarity only. In this manner, the particles to be charged are subjected to only one polarity of corona and are, therefore, charged in the conventional manner; however, the dust layer is subjected to both positive and negative corona.

An important feature of the invention is the use of a dielectric surface to receive ions from a corona discharge and thus act as an electrode, the electrode being formed from a dielectric layer having lateral dimensions large compared to its thickness. As is known, dielectrics have been used as capacitors to pass alternating current but not to allow average or direct current to pass. For generating ozone, a discharge is sometimes produced in air between two glass plates with a high alternating current voltage applied to metal plates outside the glass plates. In this manner, the glass plates act as electrodes for a discharge between them with the glass plates acting as current-limiting capacitors. In the present invention, a dielectric layer is used as a passive electrode which is alternately exposed to corona from a positive emitter and then to corona from a negative emitter. That is, when the electrode receives ions of one sign on one face, the dielectric layer must receive charges of the opposite sign on the opposite face.

Specifically, and in accordance with the invention, a device for charging particles entrained in a gas stream is provided comprising an emitter electrode in the gas stream for producing ions of one polarity which charge particles in the gas stream, a surface to which the ions are attracted and on which a portion of the charged particles collect, and a second emitter electrode for producing ions of the opposite polarity which neutralize the ions of said one polarity which have been attracted to the aforesaid surface.

In certain embodiments of the invention, the positive and negative corona produced by the two emitter electrodes are continuous in time while the passive electrode to which ions are attracted moves relative to the emitting electrodes. In this manner, a given point on the passive electrode is alternately subjected to positive and negative corona; however the aerosol passages are fixed relative to the emitting electrodes. In these embodiments of the invention, the positive and negative corona areas are separated such that a given stream of aerosol to be charged can be subjected to only one polarity of corona.

In another embodiment of the invention, stationary passive electrodes are utilized; while the dust layer is subjected to alternating positive and negative corona pulses. One emitter, usually negative, is located midway between relatively widely-spaced and stationary passive electrodes. The positive emitters are parallel to, and relatively close to, the passive electrodes and arranged such that the positive corona occurs between the positive emitters and the passive electrodes. The gas stream is baffled so that there is negligible flow in the region between the positive emitters and the passive electrodes, meaning that the aerosol stream is confined to the region between positive emitters such that the aerosol is subjected to negative corona only.

The above and other objects and features of the invention will become apparent from the following detailed description taken in connection with the accompanying drawings which form a part of this specification, and in which.

Figure 1:
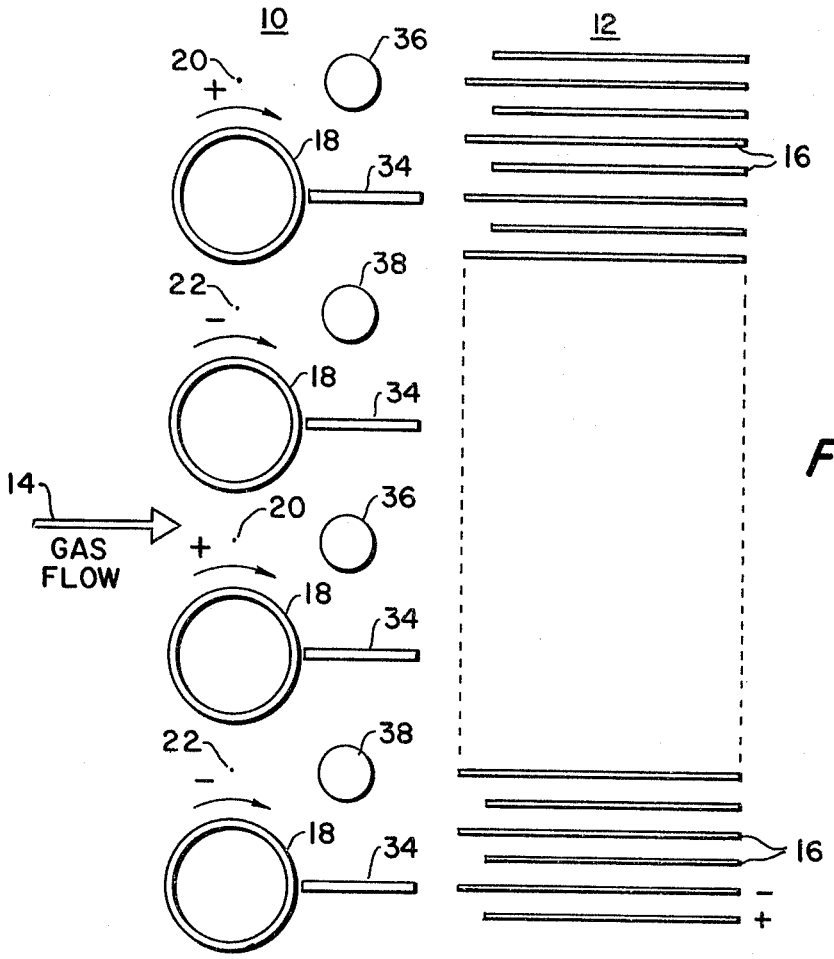
FIG. 1 is a schematic illustration of a two-stage electrostatic precipitator wherein the system for charging particulate matter in a gas stream comprises cylindrical electrodes which rotate between corona discharges of opposite polarity.

With reference now to the drawings, and particularly to FIG. 1, there is shown schematically a two-stage electrostatic precipitator including a particle-charging section 10 and a particle-collecting section 12. Dust-laden gas flowing in the direction of arrow 14 is first charged by passing through a corona discharge. In the embodiment of FIG. 1, certain of the particles will be charged positively and certain will be charged negatively. These pass through the collecting section 12 which simply comprises a plurality of parallel plates 16, alternate ones of which the positive and the others of which are negative. In passing through the plates 16 in the collecting section 12, those particles in the gas stream which are charged positively will be attracted to the negatively-charged plates 16; while those which are charged negatively will be attracted to the positively-charged plates. It will be appreciated that FIG. 1 is a diagrammatic cross section through an electrostatic precipitator and that the elements shown extend for a considerable distance into or out of the plane of the drawing.

In the embodiment of the invention shown in FIG. 1, rotating cylinders 18 form passive electrodes. Wires or corona-emitting electrodes 20 and 22 are located between the rotating cylinders 18 and are of alternate polarities. Thus, the emitting electrodes 20, for example, may be positively-charged; while the electrodes 22 are negatively-charged. One side of each cylinder is exposed to a negative corona charge while the other is exposed to a positive corona charge. Furthermore, the dust particles passing through the area occupied by the negative electrodes 22 will acquire a negative charge; while those passing through the areas occupied by the positive electrodes 20 will acquire a positive charge. The passive electrodes 18 are intended primarily to complete the electrical circuit which produces the corona discharge from the ionizing electrodes 20 and 22. However, some dust is inherently deposited on the rotating electrodes 18. As explained above, if the deposited dust includes dust of high electrical resistivity, there may result an excessive voltage gradient through the layer of collected dust. In conventional apparatus this results in an electrical breakdown of the dust layer at one or more points and a localized breakthrough of the current at these points is to produce undesirable back-corona.

With the arrangement of FIG. 1, the corona discharge produced by electrodes 22, for example, tend to impart a negative charge to the dust layer on the cylinder 18; while the corona discharge from electrodes 20 will tend to impart a positive charge. The corona current applied to the electrodes 20 and 22 and the speed or rotation of the cylinders 18 must be controlled so that the breakdown voltage of the dust layer formed on a cylinder 18 is not exceeded as the cylinder rotates through 180° past an electrode of one polarity. As the cylinder rotates through the next 180°, the electrode of the opposite polarity tends to impart the opposite charge to the dust layer, thereby preventing the build-up of a voltage gradient across the dust layer.

The corona current in the negative region of each cylinder 18 must be equal to the positive current on the opposite side of the cylinder except for any current which can be conducted through the dust layer. It is relatively easy to devise circuits whereby the total negative current is equal to the total positive current. However, differences in dust layers and irregularities in wire spacing will give local irregularities in corona current density.

Figure 2:
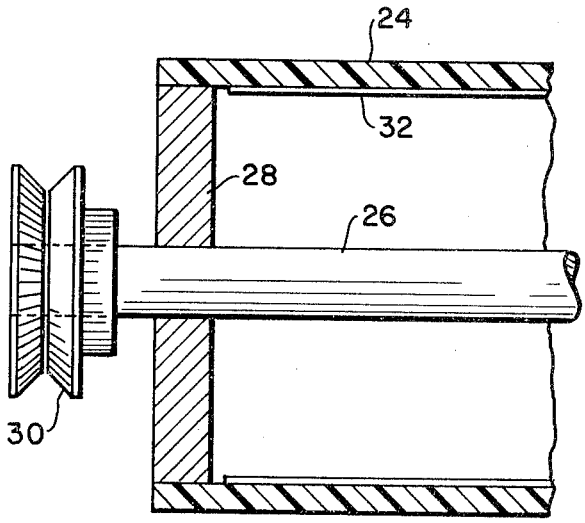
FIG. 2 is a cross-sectional view of the rolls employed in the embodiment of FIG. 1.

For moderately-high resistivities, it is feasible to equalize the positive and negative corona discharges so that the difference can be conducted through the dust layer. Under these circumstances, a metal cylinder 18 can be used. However, as the resistivity of the dust layer is increased, the fraction of the corona current which can be conducted through the dust decreases. It then becomes impractical to balance the local current densities with sufficient accuracy. Therefore, cylinders 18 preferably take the form shown in FIG. 2. Each comprises an outer tubular member 24 formed from insulating material such as polyvinylchloride. The cylinder is supported on a shaft 26 by discs 28, only one of which is shown in FIG. 2. The cylinder 18 can be rotated by means of a V-belt passing around pulley 30. On the inner peripheral surface of the cylindrical member 24 is a conducting liner 32 which is preferably isolated from ground and through which current flows between points of different electrical potential. The thickness of the wall of the cylindrical member 24 is such that the applied voltage will not cause breakdown between the liner and the dust layer.

In the operation of the embodiment of the invention shown in FIG. 1, negative ions are deposited on one side of each of the rotating cylinders 18 from the negative corona region generated by the electrodes 22. These ions are then carried around by rotation of the cylinders 18 to the positive corona regions produced by the electrodes 20 where the negative charge is initially neutralized and then the surface is charged positively. Inside the cylinders 18, the negative capacitive charging current is continuously carried from a negative region to a positive region by the conducting liner 32.

On the downstream side of the charging section 10, it is important that negative gas ions produced by the electrodes 22 do not pass to the positive regions produced by electrodes 20 where they would neutralize the positively-charged dust passing to the collection section 12. Likewise, positively-charged dust particles produced by electrodes 20 must pass into the negatively-charged regions produced by electrodes 22. Insulating barriers 34 shown in FIG. 1 are, therefore, provided to block such passage of ions. These barriers should be relatively short in the direction of gas flow so that excessive space charges do not develop with high-density aerosols.

For applications where it is desirable to mix negatively-charged dust with positively-charged dust before passing into the collection section of the precipitator (as described in my U.S. Pat. No. 3,966,435), high mobility gas ions should not be carried along with the charged dust since, as the two streams mix, these mobile ions will tend to neutralize dust particles having the opposite charge. For high-dust densities, the space charge of the dust can provide fields which will repel high mobility ions. However, for low densities, electrodes 36 and 38 are provided downstream of the corona-emitting electrodes 20 and 22. The electrodes 36, for example, are of positive polarity and preferably at the same potential as the emitting electrodes 20. Similarly, electrodes 38 are of the same polarity and potential as the emitting electrodes 22. The diameters of electrodes 36 and 38 are such that they will not produce a corona discharge and simply act to slow down positive or negative gas ions of high mobility.

For high-dust concentrations, the charging section 10 should be placed relatively close to the collecting section 12. In this respect, in high-dust concentrations, any large volume of aerosol with particles charged to a given polarity can develop excessive space charge fields which can produce corona from a point or edge of some grounded member. This corona will act to reduce the charge on the dust which is, of course, undesirable. Consequently, the space between the charging section 10 and the collecting section 12 should be as small as possible.

Thus, in the embodiment of the invention shown in FIG. 1, there is a positive wire on a first side of a dielectric cylinder and a negative wire on a second side of the cylinder diametrically opposite the positive wire. On the side where the corona is positive, the outer surface of the dielectric receives a positive charge; and on the inner surface the conducting liner 32 carries negative charge from the second side to the first side. As a result, at the first position or side, the outer surface receives a positive charge and the inner surface a negative charge. At an instant later when the cylinder has rotated through 180°, the polarities are reversed.

Figure 3:
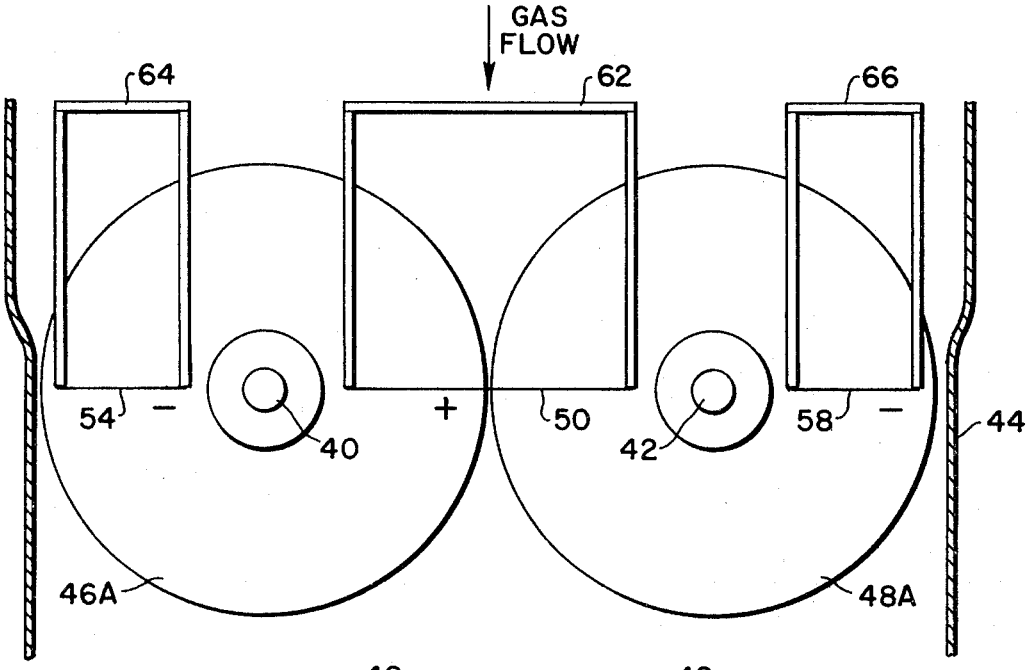
FIG. 3 is a top view of an embodiment of the invention employing rotating discs.
Figure 4:
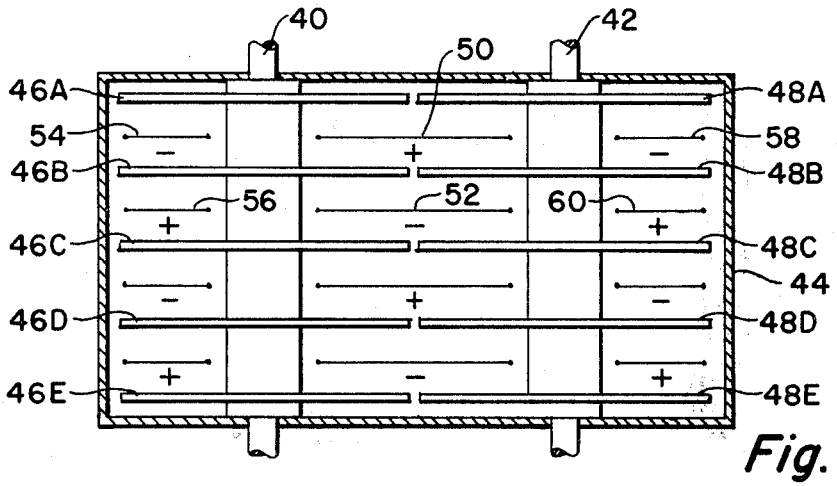
FIG. 4 is an end view of the embodiment of the invention shown in FIG. 3.

In the embodiment of FIGS. 3 and 4, two sets of rotatable discs are mounted on shafts 40 and 42 in a duct 44 carrying dust-laden gas. Carried on shaft 40 are spaced discs 46A–46E. Similarly, shaft 42 carries discs 48A–48E. Intermediate the discs 46 and 48 and on diametrically-opposite sides of the shafts 40 and 42 are alternate positive and negative corona-emitting wires. The corona-emitting wire on one side of the disc must be charged oppositely to that on the other side such that as a disc rotates, any point thereon will be exposed first to a corona discharge of one polarity and then to a corona discharge of the opposite polarity in rotating through 360°. In this respect, a positive corona-emitting electrode or wire 50 extends between shafts 40 and 42 above discs 46B and 48B while a negative corona-emitting electrode 52 extends between shafts 40 and 42 on the opposite sides of discs 46B and 48B. Diametrically opposite the electrodes 50 and 52 and on opposite sides of the discs 46B, for example, are oppositely-charged electrodes 54 and 56. Similarly, oppositely-charged electrodes 58 and 60 are provided on the side of shaft 42 opposite the center electrodes 50 and 52. As shown in FIG. 3, the top electrode 50, for example, is carried on support 62 and is connected to a positive bus along with all other positive electrodes intermediate the shafts 40 and 42. A similar negative bus, not shown, is connected to supports for all of the negative electrodes intermediate the shafts 40 and 42. Supports 64 shown in FIG. 3 are provided for all of the negative electrodes 54 to the left of shaft 40 as viewed in FIG. 4; while supports 66 are provided for all of the negative electrodes 58 to the right of shaft 42. Suitable current-carrying buses, not shown, are provided for interconnecting all of the positive electrodes and all of the negative electrodes to the opposite terminals of a source of power.

With the arrangement shown, it will be appreciated that the intermediate discs 46B–46D, for example, have a negative electrode adjacent one face and a positive electrode adjacent the other face. However, the polarities of the electrodes are reversed on opposite sides of the shafts 40 and 42. Under these conditions, the internal discs 46B–46D and 48B–48D can be of insulating material. Furthermore, as the discs rotate, any given point thereon is alternately exposed to a negative corona and a half-revolution later exposed to a positive corona.

The external discs 46A, 48A and 46E, 48E which are exposed on one side only to an electrode must have a conducting core which is necessary to conduct charging current from a positive to a negative region. However, the internal discs with negative corona on one side and positive corona on the opposite side do not need a conducting core and act as capacitors. While FIGS. 3 and 4 show only two sets of rotating discs, it should be understood that any number of sets of discs can be employed.

Figure 5:
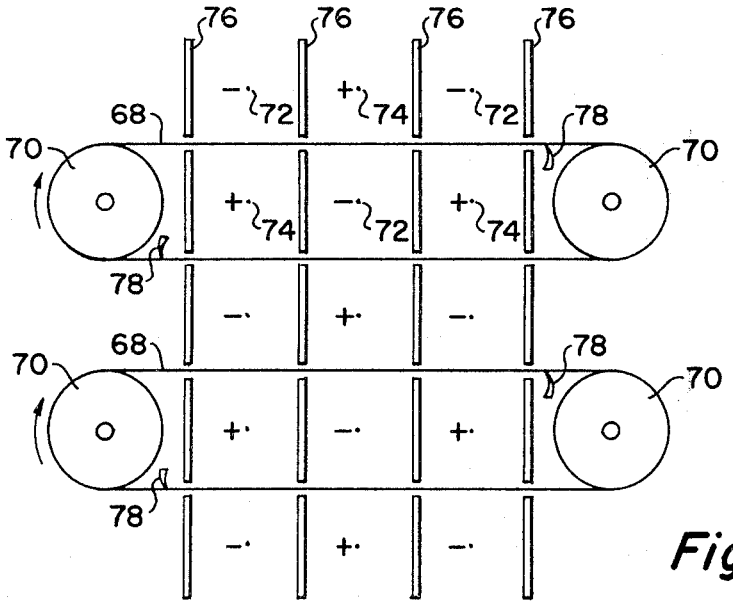
FIG. 5 illustrates an embodiment of the invention employing belts as passive electrodes.

In FIG. 5, a further embodiment of the invention is shown wherein belts of insulating material 68 are used as the passive electrodes. As shown, the belts 68 pass around rolls 70 to provide upper and lower reaches. In any active region of the belts 68 there is a negative corona-emitting electrode 72 on the other side of the belt. In this manner, the insulating belts act as capacitors with one side receiving negative charge and the opposite side receiving positive charge. Along the top and bottom reaches of each belt there are alternate positive and negative corona-emitting electrodes 74 and 72, respectively, these being separated by insulating barriers 76. As will be understood, the barriers 76, the electrodes 72 and 74, and the belts 68 extend into and out of the plane of the drawing of FIG. 5, the aerosol being directed into the plane of the drawing such that it passes through the passageways formed by the barriers 76 and the belts 68.

The charging apparatus is thus divided into passageways or ducts. As a belt moves from one duct to the next, the polarities of the corona discharges reverse with the sides of the belt which had received a negative charge, for example, now receiving a positive charge. Likewise, the side which had received a positive charge now receives a negative charge. Dust tends to be precipitated onto the belts 68. To prevent an excessive accumulation of dust, scrapers 78 are provided at those locations where the belt approaches a roll 70. The scrapers 78 are arranged to move the dust sidewise off their associated belts. It will be noted that each aerosol path formed by the ducts of FIG. 5 is subjected to only one polarity of corona while all areas of the passive electrodes are alternately subjected to positive and negative corona.

In FIGS. 1–5, particles passing through the positive corona emitters receive a positive charge and those passing the corona emitter receive a negative charge. Such a mixture of positive and negative particles can be used, for example, in the apparatus disclosed in U.S. Pat. No. 3,966,435 for giving a low-pressure drop in a fabric filter. The mixture of positive and negative particles can also be precipitated in the plate or collector section of a two-stage precipitator such as that shown in U.S. Pat. No. 2,129,783.

In some cases, however, all particles must be charged to the same polarity. This is the case, for example, in the apparatus shown in U.S. Pat. No. 3,915,672 which charges relatively high resistivity dust by using pulsed corona. The precipitator shown in that patent includes grounded plate electrodes extending parallel to the direction of airflow through the precipitator and forming passageways through which dust-laden gas passes.

It will be appreciated that in the embodiments of the invention shown in FIGS. 3–5, there are belts or discs in which, at any given point on the disc or belt, there is a positive corona on one side of the dielectric layer and negative corona on the other side. Thus, one side receives positive ions and the other side negative ions. At an instant later, that point on the dielectric has moved to a position where the polarities are reversed.

Figure 6:
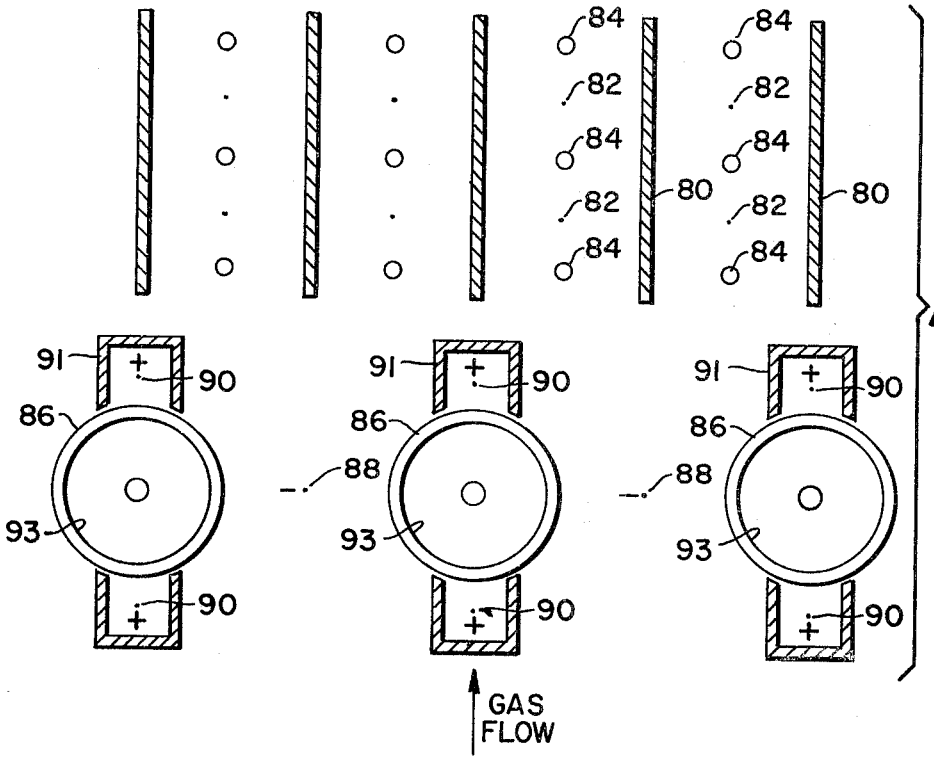
FIG. 6 illustrates an embodiment of the invention similar to that of FIG. 1 but wherein the aerosol is charged to only one polarity prior to passing through the collecting section of an electrostatic precipitator.

An arrangement requiring that all particles be charged to the same polarity is shown in FIG. 6. A plurality of corona-emitting electrodes or wires 82 is disposed between each set of grounded plates 80, the electrodes being arranged in planes parallel to the plates and midway between each pair so that the wires 82 extend parallel to the plates and are spaced apart in the planes in which they are disposed. The wires 82 are adapted to emit corona discharge when a sufficiently high voltage is applied to them; and for this purpose they must be suitably spaced apart. In a typical construction, the plates 80 are spaced apart approximately 8 inches with the row of corona wires 82 halfway between them. With this arrangement, the corona wires should be spaced apart approximately 6 inches along the direction of the aerosol stream. The wires themselves should be of small diameter so as to have a very small radius of curvature to insure local breakdown of the gas to produce corona discharge.

The corona voltage is applied to the electrodes 82 in short pulses. In order to provide a dust-precipitating electric field in the intervals between pulses, a plurality of auxiliary electrodes 84 is provided. The electrodes 84 are disposed between the corona wires 82 in the same planes and are of such configuration that no corona discharges occur on these electrodes.

In the operation of the precipitator section shown in FIG. 6, dust-laden gas passes through the passages between the pairs of grounded electrodes 80 while corona is produced on the electrodes 82 by applying short pulses of high voltage to the wires to produce the corona discharges. Between pulses, a relatively low voltage is maintained on the wires 82. During these intervals, which are much longer than the pulses, a high voltage is applied to the auxiliary electrodes 84 to maintain an electric field in the space between the electrodes 82 and 84 and the adjacent grounded electrodes 80. During the high-voltage, corona-producing pulses, a low voltage is applied to the auxiliary electrodes 84. Further details of the precipitator shown in FIG. 6 can be had by reference to the aforesaid U.S. Pat. No. 3,915,672.

The precipitator shown in U.S. Pat. No. 3,915,672 is suitable for dust resistivities up to about $2\times10^{12}$ ohm-centimeters. However, above this resistivity level, the corona pulses become so infrequent that an excessive length of precipitator is required to charge the dust. The system of FIG. 6 overcomes this difficulty by precharging the aerosol particles; however this requires that all of the particles be charged to the same sign, normally negative. For this purpose, an ionizer similar to that of FIG. 1 can be employed and comprises a plurality of rotatable cylinders 86. Intermediate the cylinders 86 are electrodes 88 which emit negative corona. These negative corona electrodes 88 are the only ones exposed to dust-laden air passing through the ionizer and the precipitator sections. In this embodiment, the opposite sign of corona occurs via positively-charged electrodes 90 enclosed within insulating enclosures 91. The enclosures 91, however, expose the corona emitted by the electrodes 90 to the surface of the rotating cylinders 86. Thus, as the cylinders 86 rotate, they will be alternately exposed to positive and negative corona, thereby producing the effect explained above in connection with FIG. 1.

Three rotating cylinders 86 are shown in FIG. 6. The cylinders themselves are formed from insulating material and are provided with inner liners 93 of electrical conducting material which may be insulated from ground. However, in a large structure, it may be desirable to substitute, for the liners 93, a relatively thick-walled inner cylinder. If the inner conductor is grounded, the outer insulating wall of the cylinder must, of course, have a greater dielectric strength.

Figure 7:
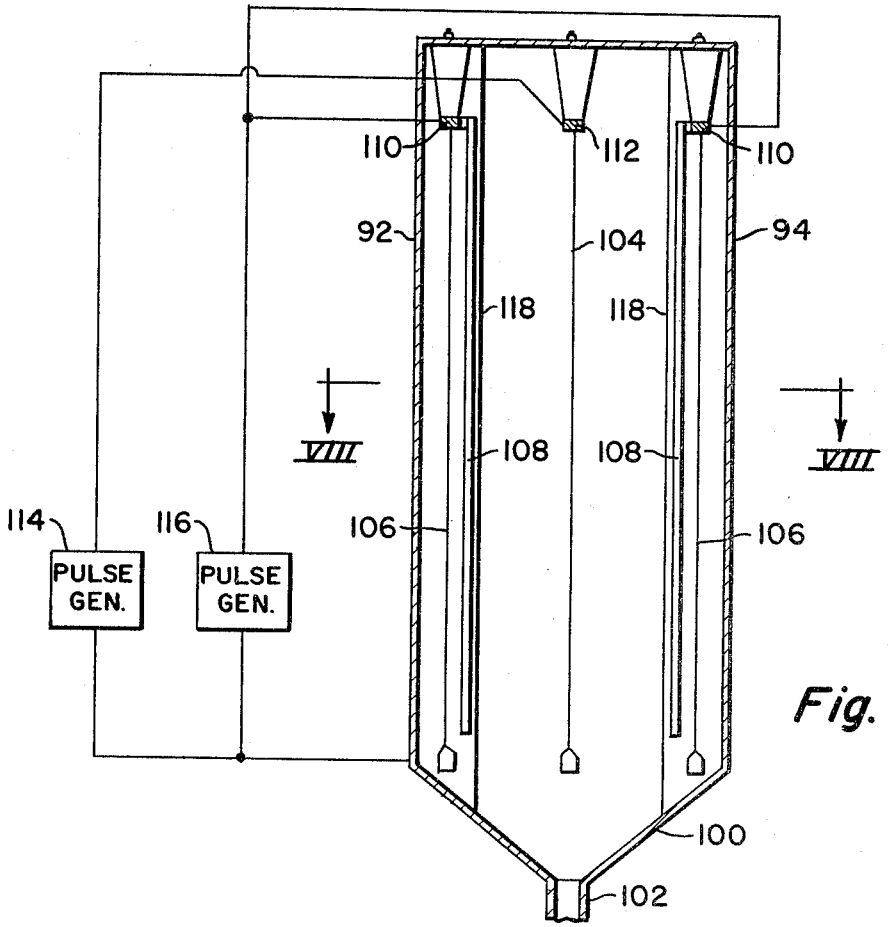
FIG. 7 is an elevational cross-sectional view of a particle-charging device employing stationary electrodes which are pulsed by suitable pulsing networks to subject a dust layer to alternate positive and negative corona pulses.
Figure 8:
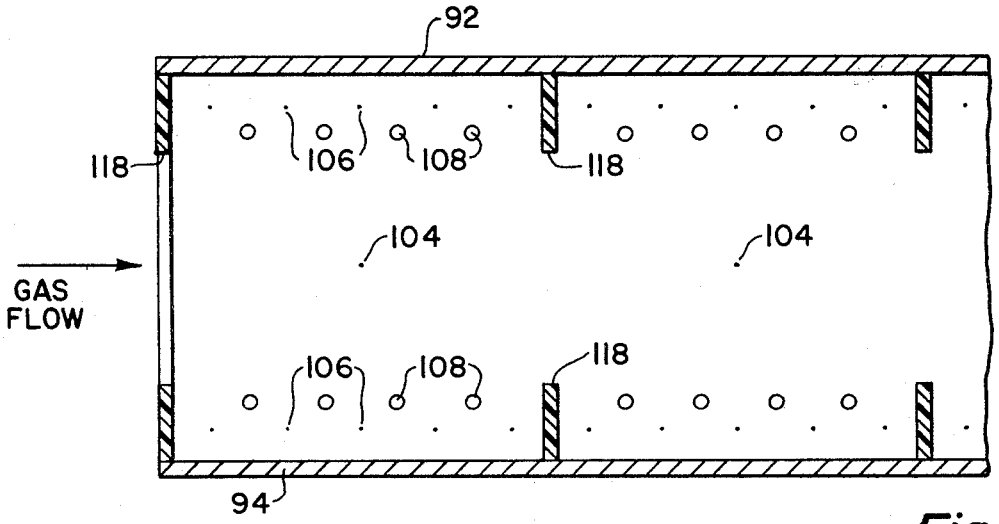
FIG. 8 is a cross-sectional view of the embodiment of the invention of FIG. 7 taken substantially along line VIII—VIII of FIG. 7.
Figure 9:
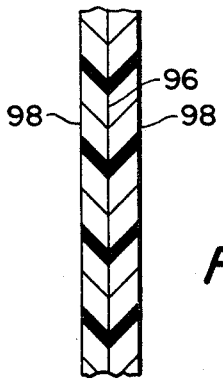
FIG. 9 is an enlarged cross-sectional view of one type of passive electrode which can be utilized in the embodiment of FIGS. 7 and 8.

Another variation of the invention which utilizes stationary electrodes is shown in FIGS. 7–9. Only one duct of a plurality of possible ducts through which dust-laden air may pass is shown in FIGS. 7 and 8 and comprises a pair of parallel, grounded electrodes 92 and 94 which can be formed from solid metal or, alternatively, can comprise a metal foil 96 sandwiched between insulating plates 98 as shown in FIG. 9. The bottoms of the passive electrodes 92 and 94 may be interconected by means of a hopper 100 with a discharge passage 102 for removal of dust collected on the plates 92 and 94.

Intermediate the two passive electrodes 92 and 94 are the main corona emitting electrodes 104. Positive corona emitters 106 are located relatively close to the passive electrodes 92 and 94. In addition to the positive corona emitters, there are additional electrodes 108. The electrodes 108, as shown in FIG. 7, are connected to bus bars 110, which are also connected to the positive corona emitters 106. Similarly, negative corona emitters 104 are connected to a bus bar 112. Connected between bus bar 112 and the passive electrodes 92 and 94 is a first pulse generator 114. Similarly, a second pulse generator 116 is connected between the positive bus bars 110 and the passive electrodes 92 and 94.

As is best shown in FIG. 8, baffles 118 extend outwardly from the inside walls of the passive electrodes 92 and 94 to restrict airflow in the area between the positive emitters 106 and the passive electrodes 92 and 94. As a result, practically all of the gas flow is between the negative corona emitters 104 and the inner edges of the baffles 118.

In the apparatus shown in FIGS. 7 and 8, corona occurs in pulses. Initially, there is a negative pulse applied to the negative emitters 104 with the positive emitters 106 at a low negative potential such that they have little influence on the negative ions between the passive electrodes 92 and 94. Following the negative pulse, there is a positive corona pulse applied to the positive emitters 106. Both sets of positive emitters on opposite sides of emitters 104 are at the same potential and the negative emitters 104 are also slightly positive at this time with the result that all of the positive ion flow is between the relatively small space between the positive emitters 106 and the passive electrodes 92 and 94.

As was explained above, the gas flow through the ionizer is between the rows of positive emitters 106 because of baffles 118; and in this region there are negative ions only. As a result, the particles entrained in the gas are charged negatively. Positive ions from the positive emitters 106 serve only to neutralize the negative ions on the deposited dust. As shown in FIG. 7, the positive emitters 106 may be suspended wires but may also be made of relatively coarse mesh, fine-wire screen. The wires of the screen should be as small as is consistent with a reasonable screen life.

As described thus far, the stationary electrode-charging system is suitable for low concentrations of dust such that the space charge due to the charged particles is negligible. The space between positive emitters 106 can be substantially equipotential so that there is no tendency to draw positive ions into the interelectrode spaces.

For high-dust densities, however, the negative space charge will tend to attract positive ions from the space between electrodes 106 and the passive electrodes 92 and 94. In order to prevent this, the electrodes 108, of much larger diameter than the electrodes 106, are provided. The electrodes 108 act as electrostatic shields to shield the positive corona emitters 106 from the electric field to the negatively-charged gas flowing through the ionizer. That is, the electric fields generated by the electrodes 108 tend to repel the positive ions emitted from the positive emitters 106 and, hence, prevent them from passing into the main gas stream. Ideally, the electrodes 108 should be at a higher positive potential than the emitters 106. However, from a cost standpoint, the two electrodes 106 and 108 are at the same potential and are connected to the same bus bars 110 as shown in FIG. 7. With this arrangement, the space between electrodes 108 and the emitters 106 is then an equipotential with no tendency to draw positive ions toward electrodes 108 and the main gas stream. On the other hand, the emitter electrodes 106 are strongly positive with respect to the passive electrodes 92 and 94 with the result that the positive ions generated by the electrodes 106 are drawn to the passive electrodes to neutralize the charge produced when the negative emitters 104 are pulsed. The electrodes 108 can be formed of solid metal but preferably consist of a metal core covered with insulation.

Figure 10:
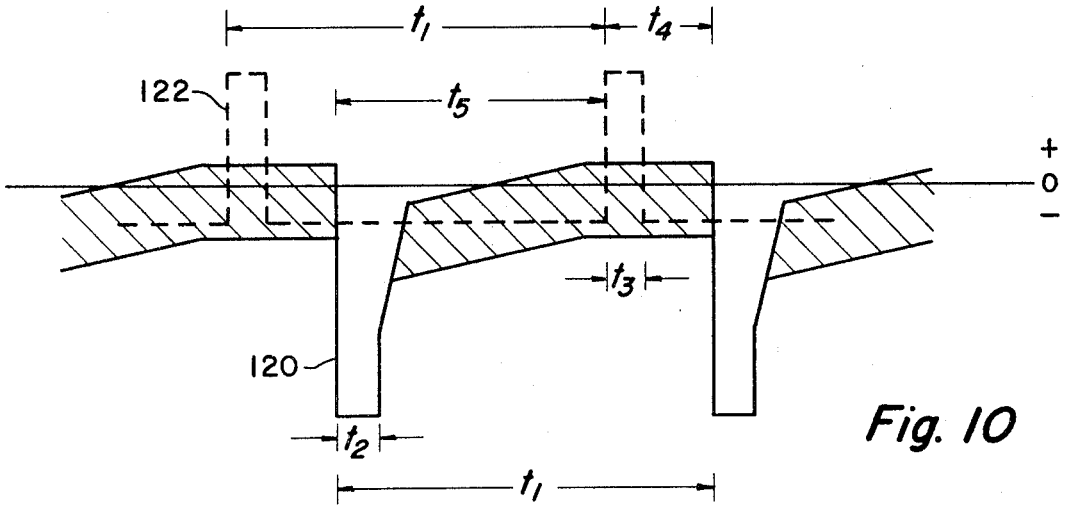
FIG. 10 comprises waveforms illustrating the pulses applied to the emitting electrodes in the embodiment of FIGS. 7 and 8.

The general character of the pulsed voltages applied to the electrodes 104 and 106 is illustrated in FIG. 10 wherein the negative potential generated by pulse generator 114 is represented by a waveform 120 while the positive potential applied to emitters 106 and 108 from pulse generator 116 is identified by the broken-line waveform 122. Note that waveform 122 assumes a slightly negative potential except during the occurrence of positive-going pulses. Between negative-going pulses in waveform 120, the voltage on the emitter 104 may become slightly positive as illustrated in FIG. 10; however the decay of the negative pulse voltage is dependent upon dust density and consequent space charge. Accordingly, depending upon these factors, the waveform 120 may or may not become positive between negative pulses. In FIG. 10 the possible range of the upper level of waveform 120 is indicated by the cross-hatched area, the lower extremity of the cross-hatched area being the expected level.

The interval, $t_1$, between both negative and positive pulses is typically about 10 milliseconds; while the duration of both the positive and negative pulses, $t_2$ and $t_3$, is typically about 1 millisecond. Following the negative pulse in waveform 120, the negative ions must travel from emitters 104 to the passive electrodes 92 and 94; and during this period the pulse voltage decays gradually as shown in FIG. 10 and may become slightly positive during the existence of the positive pulse. The magnitude of the positive pulses in waveform 122 is chosen such that the average positive corona current will equal the average negative corona current. The interval, $t_5$, between the negative pulses in waveform 120 and the positive pulses in waveform 122 is preferably greater than the interval, $t_4$, between a positive pulse and the next negative pulse. This is because the distance from the negative emitters 104 to the passive electrodes 92 and 94 is greater than the distance from the positive emitters 106 to the same passive electrodes. As will be understood, it is desirable to clear the negative ions from the space between electrodes 106 and the passive electrodes 92 and 94 before the positive pulse and to clear positive ions before the negative pulse. In this manner, ions of only one polarity exist in the space between the passive electrodes and emitters 106 at any one time, notwithstanding the fact that the polarity of the ions in this space is alternating continuously.

A reasonable spacing between the passive electrodes 92 and 94 might be 12 inches with the positive corona-emitting electrodes 106 spaced 1.5 inches from the passive electrodes. With an aerosol velocity of 60 inches per second into the ionizer and at a pulse repetition rate (both positive and negative) of 100 pulses per second, the aerosol travels only about 0.6 inch between pulses. As a result, a given particle is bombarded by many pulses in passing through the charger. A typical transit time of negative ions from the emitters 104 to the passive electrodes is on the order of about 1.5 milliseconds. With a spacing of 10 milliseconds between successive positive and negative pulses, this affords adequate time to substantially clear the space between the electrodes 106 and the passive electrodes 92 and 94 of negative ions before the pulse of positive corona such that the positive corona does not neutralize the negative ions before reaching the passive electrodes.

When passive electrodes such as that shown in FIG. 9 are used, the inner conducting film 96 must be connected to the low-voltage side (i.e., ground) of the two sources 114 and 116 of pulsed power. At the instant when the dielectric 98, for example, is receiving negative charge due to corona from the wires 104, negative charge flows through the conducting film 96 to the low-voltage side of the power supply. At an instant later, when the electrodes 106 are energized, the polarities are reversed.

From the foregoing, it will be appreciated that in all embodiments of the invention, at any given instant, a given area of dielectric is receiving charges of opposite polarity on its outer and inner surfaces; and at an instant later, the polarities are reversed. This action resembles that of a capacitor in that a given dielectric surface alternately receives positive and negative charges; but in this case negative charge comes from an emitter of negative corona and positive charge comes from a different emitter.

The present invention thus provides a system for charging high resistivity dust by using passive electrodes which are alternately exposed to positive and negative corona and by providing streams of aerosol to be charged such that any given aerosol stream is exposed to only one sign of corona. The magnitude and frequency of the corona pulses are chosen such that each corona pulse can be stored on the surface of the dust layer as a capacity charge and subsequently neutralized by the opposite polarity of corona. As a result, no current need be conducted through the dust layer and there is no upper limit to the resistivity of the dust which can be charged.

Although the invention has been shown in connection with certain specific embodiments, it will be readily apparent to those skilled in the art that various changes in form and arrangement of parts may be made to suit requirements without departing from the spirit and scope of the invention.

I claim as my invention:

1. In a device for charging particles entrained in aerosol streams, the combination of passive electrodes between which said aerosol streams pass, means for alternately exposing said passive electrodes to positive and negative corona such that particles charged to one sign of corona can be stored on the surface of a passive electrode and subsequently be neutralized by the opposite polarity of corona, means including the passive electrodes for defining separate flow paths which direct separate streams of aerosol to be charged past said passive electrodes, and the positive and negative corona being separated such that any given aerosol stream is exposed to only one sign of corona to charge said particles.

2. The combination of claim 1 wherein said means for alternately exposing said passive electrodes to positive and negative corona includes means for moving said passive electrodes and further includes a first stationary corona-emitting electrode of one polarity adjacent each passive electrode for causing charged particles of one polarity to collect on each passive electrode as it moves past the first corona-emitting electrode and a second stationary corona-emitting electrode of the opposite polarity adjacent each passive electrode but spaced from said first electrode for causing charged particles of the other polarity to collect on each passive electrode as it moves past the second corona-emitting electrode, the charged particles of one polarity acting to neutralize those of opposite polarity already collected on each passive electrode.

3. The combination of claim 2 wherein said passive electrodes comprise cylinders rotatable about spaced axes which lie in a common plane, and wherein said stationary corona-emitting electrodes extend parallel to the axes of the cylinders at spaced points about their peripheries.

4. The combination of claim 3 wherein said corona-emitting electrodes are diametrically opposite each other in said streams of aerosol to be charged.

5. The combination of claim 4 wherein the corona-emitting electrodes comprise positive and negative corona-emitting electrodes disposed in alternate spaces between cylinders.

6. The combination of claim 2 wherein said passive electrodes comprise rotatable discs.

7. The combination of claim 6 wherein said rotatable discs comprise at least one plurality of discs rotatable about a common axis, and said corona-emitting electrodes of opposite polarity are on diametrically-opposite sides of said common axis.

8. The combination of claim 7 wherein the corona-emitting electrodes are alternately positive and negative between successive ones of the discs on each side of said common axis.

9. The combination of claim 2 wherein said passive electrodes comprise continuous belts which pass around spaced rolls which are rotatable about axes extending parallel to the flow direction of said aerosol streams.

10. The combination of claim 9 wherein there is a plurality of belts spaced one above the other, and partitions between the reaches of said belts further divide the particle-laden aerosol streams passing through the device into separate aerosol streams.

11. The combination of claim 10 including a corona-emitting electrode in the space occupied by each of said aerosol streams.

12. The combination of claim 10 wherein alternate ones of said spaces contain corona-emitting electrodes of opposite polarity.

13. The combination of claim 1 wherein said passive electrodes are parallel to each other and wherein said means for alternately exposing said passive electrodes to positive and negative corona comprises a series of corona-emitting electrodes intermediate the passive electrodes for emitting corona of one polarity, two sets of corona-emitting electrodes each of which is adjacent an associated passive electrode for emitting corona of the other polarity, and means for alternately applying opposite polarity voltage pulses to said series of electrodes and said sets of electrodes.

14. The combination of claim 13 wherein negative voltage pulses are applied to said series of electrodes and positive voltage pulses are applied to said sets of electrodes.

15. The combination of claim 13 wherein said series of electrodes and said sets of electrodes are both stationary.

16. The combination of claim 15 wherein said series of electrodes and said sets of electrodes are both parallel to said passive electrodes.

* * * * *